United States Patent [19]

Lackner et al.

[11] Patent Number: 4,653,638

[45] Date of Patent: Mar. 31, 1987

[54] CONTAINER FOR TOOL ACCESSORIES

[75] Inventors: John R. Lackner, North Ridgeville, Ohio; Juergen Rathgeber; J. Parks Newby, both of Raleigh, N.C.

[73] Assignee: The Scott & Fetzer Company, Westlake, Ohio

[21] Appl. No.: 763,042

[22] Filed: Aug. 6, 1985

[51] Int. Cl.[4] ..... B65D 85/20

[52] U.S. Cl. ..... 206/373; 15/257 A; 312/DIG. 33

[58] Field of Search ..... D32/31; 15/257 A, 257 R, 15/323; 206/320, 349, 372, 373; 312/206, 244, DIG. 33

[56] References Cited

U.S. PATENT DOCUMENTS

| | | | |
|---|---|---|---|
| 2,268,364 | 12/1941 | White et al. . | |
| 2,340,390 | 2/1944 | Kitto . | |
| 2,386,489 | 10/1945 | McKellar | D32/31 |
| 2,450,172 | 9/1948 | Stoner | 206/320 |
| 2,491,680 | 12/1949 | Meyerhoefer . | |
| 2,497,477 | 2/1950 | Stoops . | |
| 2,534,122 | 12/1950 | Hamala | 15/323 |
| 2,634,189 | 4/1953 | Hill | 15/257 A |
| 2,829,778 | 4/1958 | Carabet | 211/60 |
| 2,920,337 | 1/1960 | Smith | 15/323 |
| 3,132,742 | 5/1964 | Shapiro et al. | 206/45.34 |
| 3,253,294 | 5/1966 | Waters | 15/323 |
| 3,339,781 | 9/1967 | Schurman et al. | 220/9 |
| 3,550,182 | 12/1970 | Kivela | 15/323 |
| 3,778,863 | 12/1973 | Westergren et al. | 15/323 |
| 3,869,265 | 4/1975 | Wolter | 55/274 |
| 3,872,538 | 3/1975 | Crouser | 15/323 |
| 3,955,237 | 5/1976 | Chateauneuf et al. | 15/323 |
| 4,175,659 | 11/1979 | Horian et al. | 206/223 |
| 4,340,139 | 7/1982 | Wilcox et al. | 206/349 |

FOREIGN PATENT DOCUMENTS

| | | | |
|---|---|---|---|
| 0498768 | 1/1939 | United Kingdom | 15/323 |
| 0765193 | 1/1957 | United Kingdom | 15/323 |

*Primary Examiner*—William Price
*Assistant Examiner*—Jimmy G. Foster
*Attorney, Agent, or Firm*—Pearne, Gordon, McCoy & Granger

[57] ABSTRACT

A container for tool accessories forms an integral, rigid, upright body. The upper part of the upright body includes means to securely and individually store accessories having short coupling tubes. A front wall in a lower portion of the body has an access opening therein whereby a storage bin is formed by front, side, and back walls of the body. The lateral sidewalls of the body are adapted to securely and individually store accessories having long coupling tubes at the four corners of the container such that the container stores a plurality of accessory items which are individually secured and accessible within a minimized storage area.

21 Claims, 5 Drawing Figures

CONTAINER FOR TOOL ACCESSORIES

TECHNICAL FIELD OF THE INVENTION

The present invention relates generally to containers and storage units. More specifically, the invention relates to a portable container for tool accessories, and in a particular embodiment a portable container for vacuum cleaner accessories and attachments.

PRIOR ART

Numerous appliances such as vacuum cleaners typically are used along with a variety of accessories and attachments which have specific cleaning or working applications. For example, with vacuum cleaners, cleaning nozzles attached to the end of a primary hose can be shaped low and wide, thin, or long, and with or without brushes. The nozzles usually have a head portion carried on the end of a shank adapted to mate with a connection on the end of the flexible primary suction hose. The nozzle shanks are commonly short in length, on the order of a few inches, and tubular in section.

In addition to cleaning nozzles, one or more extension tubes may be used to augment the effective length or reach of the primary hose. The extension tubes are elongated, rigid tubes, and may include bent portions to allow cleaning in hard-to-reach places and around obstacles.

Other accessories include duster brush attachments and filters, which also are carried on one end of a short shank. Other sundry items include attachable handles, straps, cleaner fluid bottles, and disposable bags.

While not exhaustive, the above-mentioned list of accessories indicates at least three broad categories. These are accessories or nozzles carried on the ends of short attachment or mating shanks, elongated tubular extensions, and miscellaneous items which are not necessarily attached to the primary appliance by a hose coupling.

Such a numerous and wide variety of shapes, sizes and lengths poses a substantial storage, shipping, and handling problem, particularly for the consumer. More than a dozen attachments can be included with an appliance kit and the user often will find it necessary to use one or more of these attachments during a single cleaning of a home, office, or even within one room. For example, a low, flat nozzle may be needed to clean under a sofa, while a brush nozzle and extension tube may be needed to reach ceilings or drapery tops.

Various receptacles and kits have been made which attempt to solve the aforementioned problems; however, such containers typically rely on hooks, clips, or fabric loops to hold the tubular shank portions of the attachments and do not provide individual storage areas for securing the various accessories. The use of straps or loops can be cumbersome with longer attachments, and the lack of individualized storage areas can lead to having to sort through various attachments to find the particular tool required for the job at hand. The lack of specialized areas for storing similar articles also results in an inefficient use of storage space.

SUMMARY OF THE INVENTION

The present invention provides a new and useful container for shipping, storing, and carrying tools such as vacuum cleaner accessories. According to one aspect of the invention, a container is provided which individually secures each attachment during shipping or handling and the accessories are individually accessible for use.

According to another aspect of the invention, the container is fully portable and can be hung on a wall and the accessories stored therein are readily viewable.

According to yet another aspect of the invention, a container is disclosed which is sturdy and reliable, yet economical to manufacture.

Another aspect of the invention is a container which provides separate storage areas for similar attachments, including a storage bin area for bottles, straps, bags, and like articles.

Still another aspect of the invention is a container which advantageously utilizes the shank portion of accessory nozzles to minimize the storage area required.

These and other aspects and advantages of the invention will be more fully understood from the following description of the invention in view of the accompanying drawings.

DESCRIPTION OF THE PREFERRED EMBODIMENTS

Figure 1:
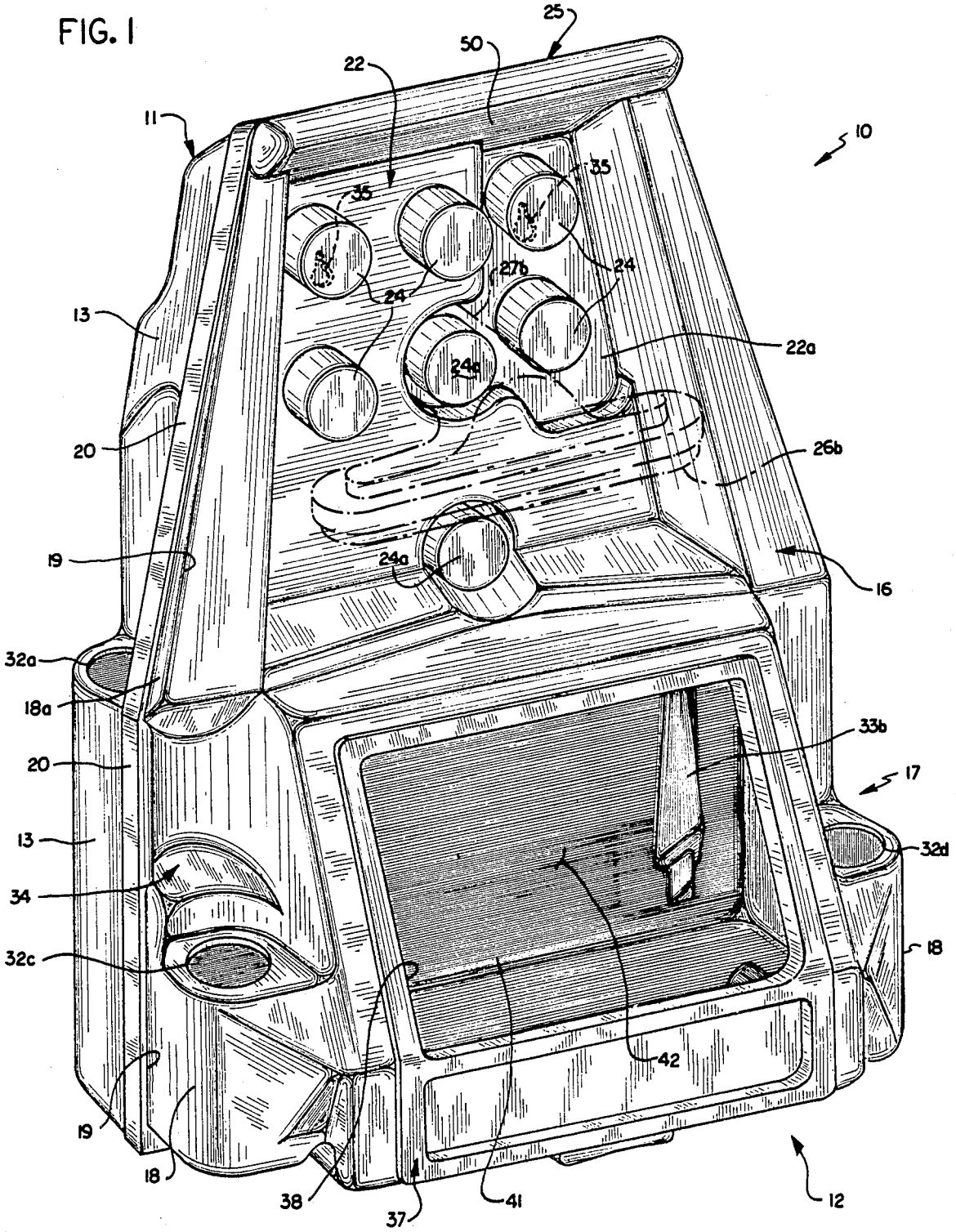
FIG. 1 is a perspective view of an accessory container embodying the concepts of the present invention for a primary appliance such as a vacuum cleaner.
Figure 2:
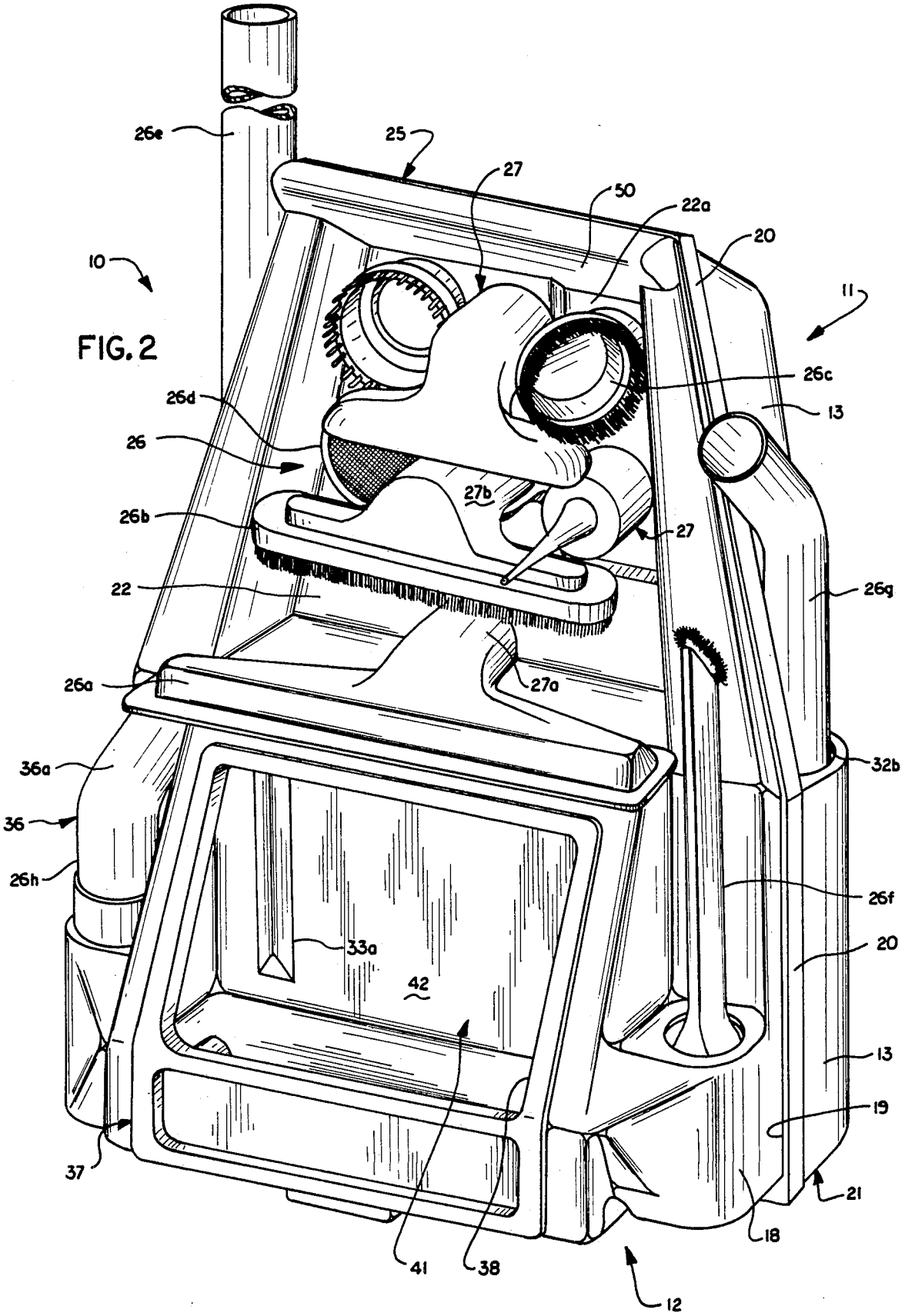
FIG. 2 is a perspective view of the same container taken from a different angle and with the various attachments being shown in a preferred arrangement.

A portable container according to the concepts of the present invention forms an upright body generally indicated by the numeral 10 in FIGS. 1–5. The container is a rigid structure and includes an upright, pan-shaped back member 11 and a contoured front member 12. Back member 11 is integrally formed with sidewalls 13 which flare outwardly from the periphery of a wall 14 (FIG. 2).

While the preferred embodiment is described with particularity as a container for vacuum cleaner accessories, such use should not be interpreted in a limiting sense. It is contemplated that the container described herein is useful for storing, transporting, carrying, and shipping many kinds of tool accessories which are of the generally described type.

Front member 12 is integrally formed with a recessed upper portion 16 and a lower portion 17. A sidewall 18 extends laterally forward from a peripheral edge 19 of front member 12. Preferably, front member 12 is formed with the back members 11 as an integral, double wall, blow-molded unit. However, the front member 12 may also be formed as a separate piece to be joined to back member 11, along a common edge 20 such that front member 12 and back member 11 form an integral and rigid structure. At the bottom of the container 10, sidewalls 13 and 18 form a generally flat bottom wall 21 such that the container 10 is properly supported and stands in an upright position, as in FIG. 1, when the container is set on a level surface such as a floor.

Figure 4:
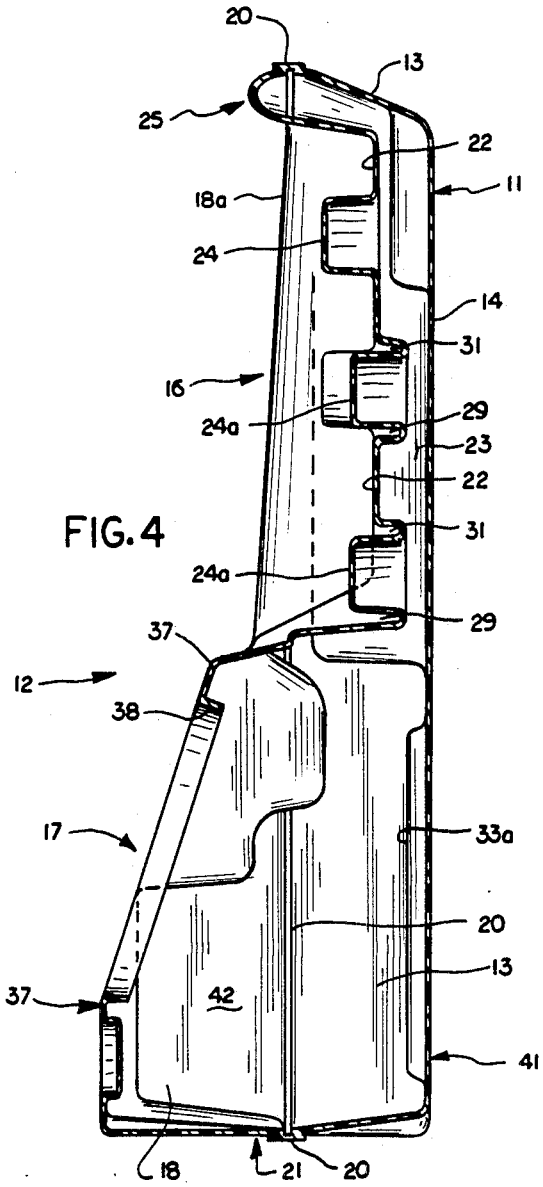
FIG. 4 is a cross-sectional view of the container shown in FIG. 1 along line 4—4.
Figure 5:
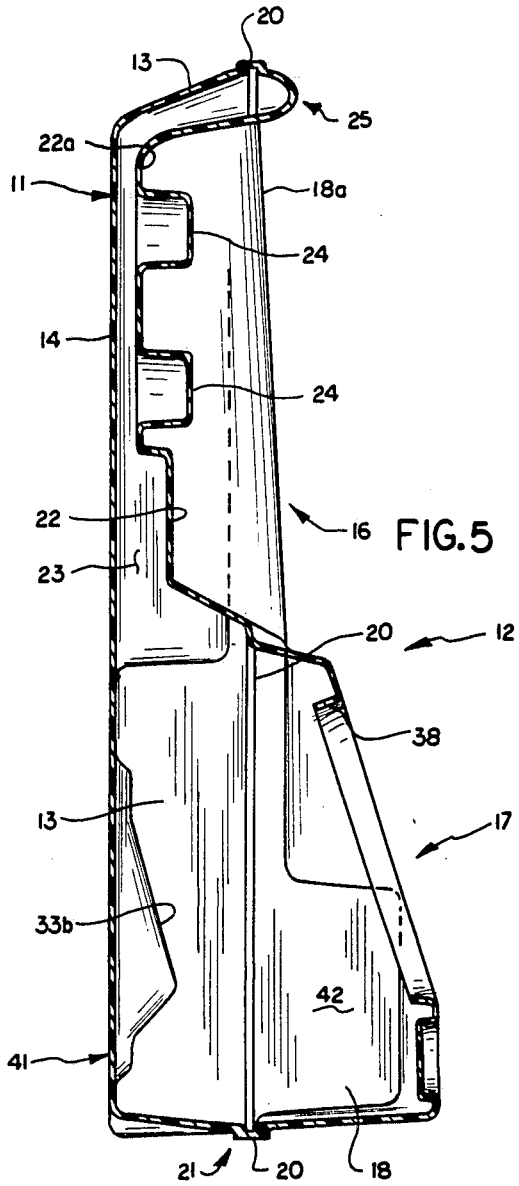
FIG. 5 is a cross-sectional view of the container shown in FIG. 1 along line 5—5.

As best shown in FIGS. 4 and 5, upper portion 6 of front member 12 includes a rear panel 22 which is preferably recessed from upper sidewall 18*a* and is contoured to fit within an upper portion 23 of back member 11. Panel 22 includes a plurality of bosses 24 extending laterally therefrom which are used to securely hold various attachments 26 (FIG. 2) having short shanks or coupling tubes 27. Bosses 24 have an outer diameter appropriately sized to slidably engage with an end portion of the inner surface of coupling tubes 27 for form a snug friction fit therwith. Thus, each attachment 26 is securely and individually held in place by its respective boss 24 transversely of the wall 14 and each attachment is separately removable from recessed upper portion 16. A particular advantage of recessing rear panel 22 from sidewall 18*a* is that attachments 26 are securely held substantially over bottom wall 21 so that container 10 is balanced and will not tip over.

Recessed upper storage area 16 of front member 12 also provides a handle 25 formed in part by the inner interior wall surface 50 along the top of container 10. Handle 25 provides a convenient means for grasping container 10 without removing or accidentally loosening the accessories and thus the container is conveniently and completely portable. Hanger holes 35 are provided in the top portion of the wall 14 so that if desired the container with tools may be supported on hanger nails against a closet wall or the like for storage.

Since many vacuum cleaner attachments include a relatively short coupling tube which is normally used to connect the attachment to the vacuum cleaner, the disclosed container advantageously uses this coupling tube feature to individually store and secure each attachment all within a relatively small recessed storage area. While a particular arrangement of the attachments is shown in the drawings, this is for exemplary purposes only. The actual arrangement of the accessories within upper portion 16 can be altered to allow for the possible various shapes and sizes of the attachments.

Referring to FIG. 2, certain vacuum cleaner attachments, such as a surface nozzle 26*a* and a utility brush nozzle 26*b*, can be larger and heavier than other attachments, such as a duster brush 26*c* or a filter screen 26*d*. To ensure that such larger nozzles are securely held, a double boss arrangement is provided, as best shown in FIG. 4. Rear panel 22 includes one or more bosses 24*a* recessed from the outer surface of rear panel 22. By recessing the boss 24*a* from panel 22, a narrow, annular space 29 extending generally radially from boss 24*a* is formed in the rear panel 22. An annular portion 31 of the rear panel 22 is radially spaced from and generally concentric with the respective boss 24*a*. The annular space 29 is appropriately sized so that the annular surface 31 of panel 22 engages or nearly engages the outer perimeter of a coupling tube 27*a* on the larger surface nozzle 26*a*. This arrangement provides added support for the larger attachments and particularly prevents such attachments from twisting or bending off the respective boss. The panel 22 may be provided with a recessed portion 22*a* thereof to maintain the larger attachments 27 above the bottom wall 21. The preferred "stacking" arrangement shown in FIG. 2 allows minimal use of storage space.

In addition to attachments having relatively short coupling tubes, a vacuum cleaner accessory package typically includes one or more elongated tubular attachments, such as an extension wand 26*e* and a crevice tool 26*f*. Certain elongated attachments, such as extension tool 26*g* and swivel attachment 26*h*, may have bent portions in order that the various nozzle and brush attachments can access difficult-to-reach areas.

Figure 3:
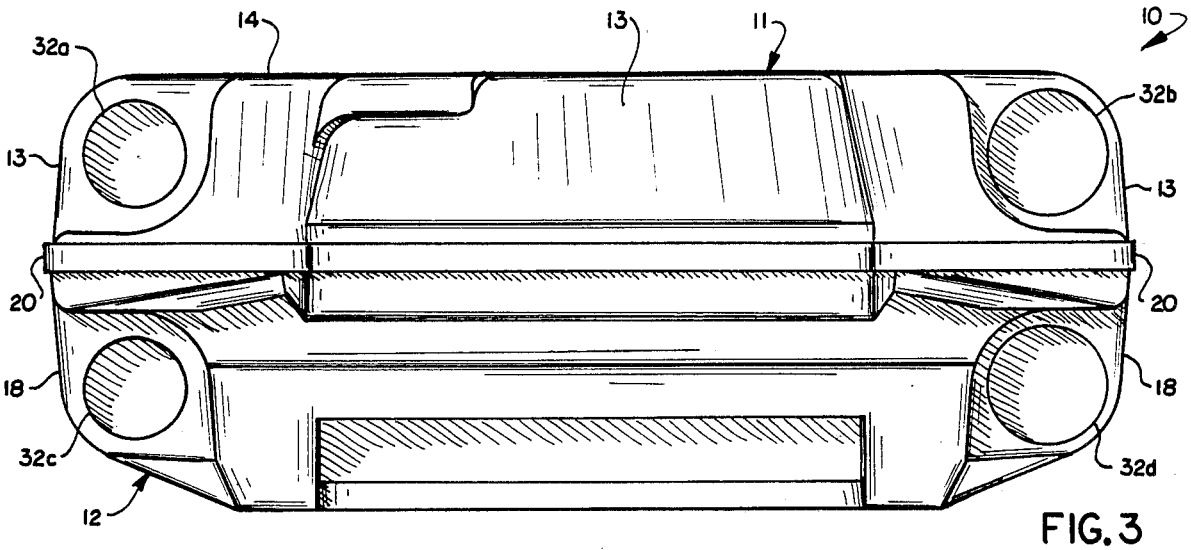
FIG. 3 is a top view of the container shown in FIG. 1.

As best shown in FIG. 3, lateral sidewalls 13 and 18 are terraced and are provided with substantially radially horizontal apertures 32 therein which respectively and slidably receive one end of a respective elongated attachment. The elongated attachments are thus individually and securely held upright about the periphery of container 10, which makes the elongated attachments easily accessible and prevents the longer attachments from interfering with the access and storage of the shorter attachments.

As shown in FIGS. 1 and 2, a pair of retaining ribs 33*a* and 33*b* extending upwardly from near the bottom wall 21 are provided on the inner surface of the wall 14 near apertures 32*a* and 32*b*, respectively, in back member sidewalls 13. The ribs 33 engage portions of the outer surface of the elongated attachments, such as extension wand 26*e* and tool 26*g*, with a camming type action as the attachment is inserted through their respective apertures 32. By abutting the tubes 26*e* and 26*g* up against ribs 33*a* and 33*b*, respectively, the tubes are more securely held within the apertures. This prevents the longer tubes from rotating or twisting within the respective aperture 32, and also resists longitudinal movement of the attachment to prevent the attachment from falling out.

A recessed area 34 is provided in the front member sidewall 18 behind the aperture 32*c*. The elongated swivel attachment 26*h* has a bend 36 therein for purposes described hereinbefore. The attachment 26*h* is inserted into aperture 32*c* and the recessed area 34 permits the attachment 26*h* to be rotated so that the bent end 36*a* is placed sideways and does not extend beyond the outer perimeter of the container 10.

The lower portion 17 of the front member 12 includes a front wall 37 opposite a lower portion 41 of the back member 11 and has an access opening 38 therein which slants gently backward. The access opening 38 is formed by simply cutting out a portion of the double wall unit, preferably a portion of the front member 12. As best shown in FIGS. 1 and 2, front wall 37, bottom wall 21, lateral sidewalls 13 and 18, and lower portion 41 of back member 11 form a storage bin area 42 below the recessed storage area 16 and accessible through the opening 38 in the front wall. This storage area can be used for holding various sundry items and accessories which are non-tubular or otherwise not attached to the vacuum cleaner, e.g., straps, handles, sprayer/dispenser heads, reservoir bottles, and disposable vacuum bags. Although not shown in the drawings, a particularly convenient feature of this arrangement is that the vacuum cleaner bags may be stored in the bin 42 so as to cover the opening 38 prior to use. The bags will prevent the items stored within the bin 42 from falling out or rattling around, which is a particularly desirable arrangement during shipment of the container.

The preferred embodiment of the invention provides many advantages and conveniences over containers known heretofore. For example, according to the present invention, each attachment is individually secured and separately accessible without cumbersome interference from other attachments. All of the short coupling tube attachments are stored within one area and are easily viewable to locate the desired tool. The longer attachments are peripherally stored about the container in an upright manner to minimize the overall size of container 10. By locating the storage bin 42 under the recessed upper storage area used to store the short coupling tube accessories, the container 10 is more stable, since the weight of the items in the bin will help prevent the container 10 from being top-heavy. The use of specialized storage areas for similar attachments, as, for example, bin 42 and recessed storage area 16, is particularly convenient for immediately locating a particular attachment or item needed.

To provide an economical yet durable container, front and back members 11 and 12 are integral and preferably made with a blow-molded plastic such as high density polyethylene. This provides a strong, rigid structure which will easily support the various attachments and accessories.

Though not shown in the accompanying drawings, other embodiments are within the scope of the present invention. For example, a single-piece container can be made from separate front and back members attached together along their respective perimeters rather than the integral blow-molded unit. Also, the wall 14 of the back member 11 can be provided with hanger means other than the holes 35 or, less preferably, the hanger means may be omitted.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A container for tool accessories comprising a rigid structure having an upright body with sidewalls extending laterally thereto and about the perimeter thereof, an upper storage area of said upright body having mounting means therein for securely and indivudually mounting at separate positions accessories having short coupling tubes, a front wall attached to the perimeter of said lateral sidewalls opposite a lower part of said upright body and having an access aperture therein whereby a lower storage bin is formed by said front wall, lateral walls, and a rear portion of said upright body below said upper storage area, said lateral sidewalls providing support means separate from said storage bin adapted to securely and individually store accessories having long coupling tubes at separate positions in which said accessories extend exteriorly of said sidewalls whereby the container stores a plurality of accessory items individually secured and accessible within a minimized storage area.

2. A container according to claim 1, wherein said means for securely and individually storing accessories with short coupling tubes is at least one boss extending laterally from the rear side of said upright body and adapted to slidably engage with a friction fit the free end of a short accessory coupling tube along the inner periphery thereof.

3. A container according to claim 2, wherein at least one boss is recessed with respect to said upright body whereby an annular portion of said upright body concentrically surrounds said boss and is radially spaced therefrom, said annular portion providing additional support to the accessory coupling tube when the tube is mounted on said boss.

4. A container according to claim 1, wherein said lateral sidewalls are provided with at least one aperture therein through which an end of a long coupling tube is inserted into the container interior, whereby said long coupling tube is securely held in a substantially upright orientation near said perimeter of the container.

5. A container according to claim 4, further comprising a rib extending upwardly on an interior surface of said upright body near said aperture whereby said end of a long coupling tube is cammed against said rib and securely held thereby when said end is inserted through said one aperture.

6. A container as in claim 1, said upper storage area comprising a forwardly facing recess in the upper portion of said upright body, wall means including said lateral sidewalls surrounding the sides and top of said recess and providing a carrying handle at the top thereof in the form of a graspable ledge.

7. A container for vacuum cleaner accessories in the form of an upright body comprising a back member and a front member, said back member being generally pan-shaped and attached to said front member, said front member being integrally formed and having a recessed upper portion and a lower portion, said recessed upper portion providing mounting means for collectively storing relatively short accessories, and for securely holding each of said short accessories independently of other short accessories with each being individually removable from said upper portion, said recessed upper portion being contoured to fit within an upper part of said back member, said lower portion of said front member having a front wall with an access window therein, said front and back members being securely joined about their peripheral edges such that the lower half of the container is a storage bin for non-tubular accessories and accessible through said window and said short accessories are stored within said recessed portion above said storage bin to minimize the depth of the container, said front and back members having apertures on the sides thereof adapted to receive relatively long accessories such that the container can store numerous accessory items, each individually secured and removable within a minimum storage space.

8. A container according to claim 7, wherein said means for collectively storing said short accessories is at least one boss extending laterally from a rear panel in said recessed upper portion.

9. A container according to claim 8, wherein at least one boss is recessed with respect to said rear panel in said front member, whereby an annular portion of said rear panel concentrically surrounds said one boss and is radially spaced therefrom, said annular portion slidably engaging the outer peripheral end of a short accessory coupling tube.

10. A container according to claim 9, further comprising a rib extending upwardly on an interior surface of said back member near one of said apertures whereby an end of a long coupling tube is cammed against said rib and securely held thereby when said end is inserted through its respective aperture.

11. A container according to claim 7, wherein said means for collectively storing are shaped to cooperate with tubular shanks of said short accessories whereby said short accessories are held by frictional engagement and are mounted transversely of said back member above said storage bin.

12. A container according to claim 11, wherein said short accessories are arranged in a stacked relationship to minimize the size of the container.

13. A container according to claim 12, wherein said long accessories are stored in an upright configuration supported by said apertures about the periphery of the container whereby said long accessories are individually secured and removable independently of said short attachments and said storage bin.

14. A container according to claim 1, wherein said upright body includes hanger means on the rear side thereof for supporting said container on a wall surface.

15. A container according to claim 1, wherein said upright body tapers laterally inwardly from mid-height, said sidewalls are stepped or terraced at and below midheight of the body at four corners of said body, and upwardly facing receiving openings for the long coupling tubes are formed in the stepping or terracing.

16. A container according to claim 15, wherein said stepping or terracing at the front corners of the body is lower than at the rear corners and said access opening slants gently backward between said front corners.

17. A molded plastic container for tool aqccessories comprising a rigid structure having an upright body with lateral sidewalls extending about the perimeter thereof, an upper storage area of said upright body having a plurality of integrally molded spaced-apart projections for securely and individually storing certain accessories by frictional engagement, a front wall attached to the perimeter of said lateral sidewalls opposite a lower part of said upright member and having an access opening therein whereby a lower storage bin is formed by said front wall, lateral walls, and a rear portion of said upright body below said upper storage area, and whereby the container stores a plurality of accessory items accessible within a minimized storage area, said upright body tapering laterally inward from mid-height, said sidewalls being stepped or terraced at or below mid-height of the body at four corners of said body, and upwardly facing receiving openings for long coupling tubes are formed in the step or terracing.

18. A container according to claim 17, wherein said lateral sidewalls provide mounting means to securely store certain elongated accessories in a substantially upright orientation.

19. A container according to claim 18, wherein said certain accessories have a short coupling tube which slidably receives a portion of a respective projection and is held thereon by frictional forces between the respective projection and an inner surface of said coupling tube.

20. A container according to claim 19, wherein said upright body tapers laterally inwardly from mid-height, said sidewalls are stepped or terraced at and below midheight of the body at four corners of said body, and upwardly facing receiving openings for the long coupling tubes are formed in the stepping or terracing.

21. A container according to claim 17, wherein said stepping or terracing at the front corners of the body is lower than at the rear corners and said access opening slants gently backward between said front corners.

* * * * *